US012790089B2

(12) United States Patent
Ye

(10) Patent No.: US 12,790,089 B2
(45) Date of Patent: Nov. 10, 2026

(54) EASY-PRINT PACKAGING SHEET AND MANUFACTURING METHOD THEREFOR

(71) Applicant: JIANGSU QINGYUN NEW MATERIAL CO., LTD., Nantong (CN)

(72) Inventor: Kongmeng Ye, Nantong (CN)

( * ) Notice: Subject to any disclaimer, the term of this patent is extended or adjusted under 35 U.S.C. 154(b) by 365 days.

(21) Appl. No.: 18/650,722

(22) Filed: Apr. 30, 2024

(65) Prior Publication Data

US 2024/0278965 A1 Aug. 22, 2024

Related U.S. Application Data

(63) Continuation of application No. PCT/CN2022/120720, filed on Sep. 23, 2022.

(30) Foreign Application Priority Data

Dec. 24, 2021 (CN) ..... 202111596643.3

(51) Int. Cl.

| | |
|---|---|
| ***B65D 65/38*** | (2006.01) |
| ***D21B 1/30*** | (2006.01) |
| ***D21J 3/12*** | (2006.01) |

(52) U.S. Cl.

CPC ..... *B65D 65/38* (2013.01); *D21B 1/30* (2013.01); *D21J 3/12* (2013.01); *B65D 2565/382* (2013.01)

(58) Field of Classification Search

CPC .... B65D 65/38; B65D 2565/382; D21B 1/30; D21J 3/12; D01D 5/11; D01F 1/103; D01F 6/04; D01F 6/46; D01F 1/10; D04H 1/413; D04H 1/4291; D04H 1/724; D04H 3/007; D04H 3/02; D04H 3/14; C08J 5/18; D10B 2321/021

See application file for complete search history.

(56) References Cited

U.S. PATENT DOCUMENTS

2016/0297935 A1* 10/2016 Reese ..... C08J 3/226

* cited by examiner

*Primary Examiner* — Michael C Miggins

(57) ABSTRACT

An easy-print packaging sheet and a manufacturing method therefor. Raw materials of the easy-print packaging sheet contain polyethylene; the smoothness of the packaging sheet is 70-250 seconds; the drape coefficient of the packaging sheet is 78-92%; the burst index of the packaging sheet is 8-15 kPa·m$^2$/g; and the light shielding rate of the packaging sheet is 85-95%. The packaging sheet having good comprehensive performance is prepared by means of a flash spinning process and the improvement of raw materials and a spinning process.

12 Claims, No Drawings

EASY-PRINT PACKAGING SHEET AND MANUFACTURING METHOD THEREFOR

TECHNICAL FIELD

The present invention relates to the technical field of flash spinning, and specifically relates to an easy-print packaging sheet prepared by means of a flash spinning process and a manufacturing method therefor.

BACKGROUND

Plastic sheet refers to materials for use in producing thermal-forming products such as disposable plastic cups, dishes, bowls, small dishes, and boxes. It is widely applied in the packaging of food, vegetables, fruits, beverage, dairy, industrial parts, and other fields.

With the increasing growth of domestic demands, the thermal-forming packaging plastic sheet has been applied more and more extensively and has had year-by-year increased use amount and thus, has a promising prospect. As China pays attention to environmental protection, the "production lines for eco-friendly degradable sheet" suitable for production have been able to successfully supply various types of "degradable sheets" to the market. The "nanosheet" produced by "nanoplastic" has become another focus concerned by people, and also become a new "selling point" for manufacturers. To prolong the shelf life of food, the "high barrier-property sheet" has become the target product competitively developed by manufacturers.

Common methods for producing plastic packaging sheets are a rolling process mainly used for the production of sheets such as PVC, and PVDC, and an extrusion molding used for the production of sheets such as BOPS, EPS, PET, PP, and HIPS. The sheet mentioned herein mainly refers to the sheet for thermal-forming packaging products produced by the process of "extruder-T nose-three-roller press polishing device-rolling". With the development of packaging sheet, the domestic industry for manufacturing sheet-making machine also keeps on launching advanced configurations and new machines. Over decades, enterprises for sheet production and manufacturing sheet-making machine have cooperated and introduced with each other, which also improves the overall development level of the plastic sheet industry. New sheet machining technologies and new raw/auxiliary materials exert full functions in the configuration of advanced equipment.

Currently, the traditional packaging sheet has a good burst resistance; but there exist technical problems of hard-to-print, poor degree of bending after print, and poor antimould and antibacterial effects. The process of the present application is totally different from the traditional forming process route of sheet. Products with better overall performance are prepared by means of a flash spinning process and the improvement of raw materials and a spinning process. The performance is specifically a bending property (drape coefficient), a printing property (smoothness), burst resistance (burst index), and a light shielding property (light shielding rate).

SUMMARY

The object of the present invention is to overcome the shortcomings in the prior art. Provided is an easy-print packaging sheet and a manufacturing method therefor.

The object of the present invention is achieved by the following technical solution:

An easy-print packaging sheet, where a raw material includes polyethylene;

a smoothness of the packaging sheet is 70-250 seconds;

a drape coefficient of the packaging sheet is 78-92%;

a burst index of the packaging sheet is 8-15 $kPa \cdot m^2/g$;

a light shielding rate of the packaging sheet is 85-95%; and the light shielding rate=1−total luminous flux transmittance; wherein the total luminous flux transmittance refers to a ratio of the luminous flux transmitted to an incident flux when a parallel beam transmits through a test sample.

The smoothness of the packaging sheet is 200-250 seconds, being a front measured value of the packaging sheet.

The smoothness of the packaging sheet is 70-100 seconds, being a back measured value of the packaging sheet.

The drape coefficient of the packaging sheet is 80-85%.

The drape coefficient of the packaging sheet is 85-90%.

The burst index of the packaging sheet is 8-9 $kPa \cdot m^2/g$.

The burst index of the packaging sheet is 9-10 $kPa \cdot m^2/g$.

The burst index of the packaging sheet is 10-11 $kPa \cdot m^2/g$.

The burst index of the packaging sheet is 11-12 $kPa \cdot m^2/g$.

The burst index of the packaging sheet is 13-14 $kPa \cdot m^2/g$.

The burst index of the packaging sheet is 14-15 $kPa \cdot m^2/g$.

The light shielding rate of the packaging sheet is 89.5-90%.

The light shielding rate of the packaging sheet is 90-90.5%.

An easy-print packaging sheet, where the raw material comprises polyethylene and a carbon nanoflower packaging material, and the carbon nanoflower packaging material is present in the packaging sheet in a mass fraction of 1-3%.

A method for manufacturing an easy-print packaging sheet, including the following technical steps: dissolving spinning raw materials polyethylene and a carbon nanoflower packaging material into a spinning solvent to form a spinning solution, and performing flash spinning on the spinning solution at 160-240° C. to obtain a flash-spinning fiber, performing lapping, hot pressing and lustring process to obtain the packaging sheet, wherein the hot pressing temperature is 110-130° C., the lustring temperature is 120-125° C., and the lustring pressure is 40-48 Kg/cm.

A further detailed technical solution is as follows:

A method for manufacturing an easy-print packaging sheet, including the following technical steps:

(I) Preparation of the Carbon Nanoflower Packaging Material:

the carbon nanoflower, copper chloride, and magnesium chloride are dissolved into a potassium hydroxide solution; ultrasonically stirred and mixed to generate a primary precipitate, the primary precipitate is heated and dried at a heating temperature of 180-190° C. for 1-2 hours to obtain an intermediate precipitate; the intermediate precipitate is calcinated at a calcination temperature of 320-360° C. for 2-3 hours to obtain the carbon nanoflower packaging material;

a mass ratio of the carbon nanoflower to copper chloride is 1:0.5-1:0.9;

a mass ratio of the carbon nanoflower to magnesium chloride is 1:2.5-1:3;

a mass ratio of the carbon nanoflower to potassium hydroxide is 1:15-1:20; and potassium hydroxide is kept excessive in the potassium hydroxide solution.

In the present application, the multi-dendritic structure of the carbon nanoflower is utilized to adsorb on the surface to generate a layer of copper oxide, and generate a layer of magnesium oxide; magnesium oxide covers on the surface of the copper oxide to achieve slow release, protection, anti-bacterial and anti-mould properties. Meanwhile, in the present application, the mass of the magnesium oxide is much higher than that of copper oxide to mainly shelter the black of copper oxide, which avoids affecting the printing property of the final packaging sheet product due to the improvement of anti-bacterial and anti-mould properties. Therefore, a proper range of ratio needs to be selected to obtain a raw material ratio achieving good anti-bacterial and anti-mould properties and printing property, thereby overcoming the defect of single function improvement (anti-bacterial and anti-mould properties, or printing property). Carbon nanoflower packaging material is a dendritic structure on the whole and is easy to disperse into the polyethylene substrate. This is also one of the reasons why carbon nanoflower is selected as an additive material of the present application.

(II) Preparation of the Spinning Solution:

The carbon nanoflower packaging material prepared in step (I) and polyethylene are dissolved into a spinning solvent to obtain the spinning solution; and the mixture of the carbon nanoflower packaging material and polyethylene has a mass fraction of 8-17% in the spinning solution.

The carbon nanoflower packaging material has a mass fraction of 1-3% in the mixture of the carbon nanoflower packaging material and polyethylene.

The spinning solvent is a mixture of more than two of aromatic hydrocarbons, aliphatic hydrocarbons, alicyclic hydrocarbons, unsaturated hydrocarbons, halogenated hydrocarbons, alcohols, esters, ethers, ketones, nitriles, amides, and fluorocarbons.

(III) Preparation of the Packaging Sheet:

The spinning solution prepared in step (II) is subjected to flash spinning at a spinning temperature of 160-240° C. to obtain a flash-spinning fiber, and then lapped, hot pressed and lustered to obtain the packaging sheet, wherein the hot pressing temperature is 110-130° C., the lustring temperature is 120-125° C., and the lustring pressure is 40-48 Kg/cm.

The higher the mass fraction of the carbon nanoflower packaging material in the packaging sheet is, the higher the anti-bacterial and anti-mould properties and the burst index are. That is, the carbon nanoflower packaging material shares certain load under the stress of the packaging sheet, absorbs certain stress, and can reduce the motion between polymer molecular chains, and achieves a buffer action on the crack reduction of sheet, beneficial to improving its burst resistance. However, too high content may generate agglomeration to cause defects, damaging the overall structure of the sheet. Therefore, the burst resistance is not still in a boosting state with the increase of the content, but declines on the contrary.

High mass fraction of the carbon nanoflower packaging material in the packaging sheet can fill in a portion of gaps in the fiber texture of the sheet such that the texture is more compact; the scattering ability becomes poor, beneficial to the penetration of light, and the light shielding rate decreases.

High mass fraction of the carbon nanoflower packaging material in the packaging sheet can fill in a portion of gaps in the fiber texture of the sheet such that the texture is more compact and the smoothness is higher, beneficial to printing. However, when the smoothness is greater than 250 seconds, the texture surface is too rough, which is against the entry of ink and not good for printing. A moderate range must be kept now to be beneficial for printing.

The higher the lustring pressure is, the smaller the gap between fibers is, and the more compact the texture is. When the scattering ability becomes poor, it is beneficial to the transmission of light and the light shielding rate decreases.

The higher the lustring pressure is, the smaller the gap between fibers is, and the more compact the texture is, thus causing poor bending property and decreased drape coefficient.

The present application has a light shielding rate of about 90% and poor transmission of light. The sheet of the present application has good light shielding effect to the product packaged when used as a packaging material, particularly, it functions in insulating a ray of light to the products such as food and drugs that may react with the ray of light.

The present application further provides a technical solution:

A further detailed technical solution is as follows:

A method for manufacturing an easy-print polypropylene packaging sheet, including the following technical steps:

(I) Preparation of the Carbon Nanoflower Packaging Material:

The carbon nanoflower, copper chloride, and magnesium chloride are dissolved into a potassium hydroxide solution; ultrasonically stirred and mixed to generate a primary precipitate, the primary precipitate is heated and dried at a heating temperature of 180-190° C. for 1-2 hours to obtain an intermediate precipitate; the intermediate precipitate is calcinated at a calcination temperature of 320-360° C. for 2-3 hours to obtain the carbon nanoflower packaging material;

a mass ratio of the carbon nanoflower to copper chloride is 1:0.5-1:0.9;

a mass ratio of the carbon nanoflower to magnesium chloride is 1:2.5-1:3;

a mass ratio of the carbon nanoflower to potassium hydroxide is 1:15-1:20; and potassium hydroxide is kept excessive in the potassium hydroxide solution.

(II) Preparation of the Spinning Solution:

The carbon nanoflower packaging material prepared in step (I) and polypropylene are dissolved into a spinning solvent to obtain the spinning solution; and the mixture of the carbon nanoflower packaging material and polypropylene has a mass fraction of 8-17% in the spinning solution.

The carbon nanoflower packaging material has a mass fraction of 1-3% in the mixture of the carbon nanoflower packaging material and polypropylene.

The spinning solvent is a mixture of more than two of aromatic hydrocarbons, aliphatic hydrocarbons, alicyclic hydrocarbons, unsaturated hydrocarbons, halogenated hydrocarbons, alcohols, esters, ethers, ketones, nitriles, amides, and fluorocarbons.

(III) Preparation of the Polypropylene Packaging Sheet:

The spinning solution prepared in step (II) is subjected to flash spinning at a spinning temperature of 160-240° C. to obtain a flash-spinning fiber, and then lapped, hot pressed and lustered to obtain the polypropylene packaging sheet, wherein the hot pressing temperature is 110-130° C., the lustring temperature is 120-125° C., and the lustring pressure is 40-48 Kg/cm.

Compared with the prior art, the present invention has the following positive effects:

Products with better overall performance are prepared by means of a flash spinning process and the improvement of raw materials and a spinning process. The overall performance is specifically a bending property (drape coefficient), a printing property (smoothness), a burst resistance (burst index), anti-mould and anti-bacterial properties (mould proof grade and antibacterial ratio), and a light shielding property (light shielding rate).

DETAILED DESCRIPTION OF EMBODIMENTS

Provided are detailed embodiments of an easy-print packaging sheet and a manufacturing method therefor of the present invention below.

Test Method (I) Smoothness: GB/T 456-2002 Paper and Board-Determination of Smoothness (Bekk Method)

The test was performed in accordance with the national standard; 10 samples were taken and tested to obtain their front and back smoothness, and then the smoothness values were averaged to obtain the front smoothness and back smoothness of the sample, respectively. It can be seen that there exists certain difference between the front and back smoothness.

(II) Drape Coefficient: GB/T 23329-2009 Textiles-Determination of Drapability of Fabrics The test was performed in accordance with the national standard, specifically according to method A, a paper loop method; a gripping dish diameter is 18 cm and sample diameter is 30 cm. 6 parts of samples were taken and tested three times on the front, and tested three times on the back; the values obtained were averaged to obtain the drape coefficient of the sample.

(III) Burst Index: GB/T 1539-2007/IS02759: 2001 Paperboard-Determination of Bursting Strength The test was performed in accordance with the national standard. Burst index refers to quantification that bursting strength divides by paperboard, where burst index is the maximum pressure when paper-like circular area is burst by an elastic rubber membrane under the pressure of a hydraulic system. 20 samples were taken and tested, then values were averaged to obtain the burst index.

(IV) Light Shielding Rate: FZ/T 01009-2008 Textiles-Determination of the Luminous Transmittance of Fabrics Definition: Light shielding rate=1−total luminous flux transmittance where the total luminous flux transmittance refers to a ratio of the luminous flux of a parallel beam transmitted through a test sample to the incident flux.

The test was performed in accordance with the textile industry standard. 5 samples were tested and averaged to obtain the total luminous flux transmittance, and then the light shielding rate was obtained according to the above formula.

(V) Anti-Mould Grade GB/T 24346-2009 Textiles-Evaluation for Anti-Mould Activity The test was performed in accordance with the national standard. 6 pieces of samples were taken and tested, and averaged, and then the anti-mould grade of the sample was calculated. Strains are *Aspergillus niger* CGMCC 3.5487, *Chaetomium globasum* CGMCC 3.3601, *Penicillium funiculosum* CGMCC3.3875, and *Trichoderma viride* CGMCC 3.2941. The anti-mould activity was tested at the parameters of constant temperature and constant humidity: 28° C.±1° C., 90%+2%; incubation time was 28 days.

(VI) Antibacterial Ratio: GB/T 20944.2-2007 Textiles-Evaluation for Antibacterial Activity-Part 2: Absorption Method The test was performed in accordance with the national standard. 3 pieces of samples were taken and tested, and averaged, and then the antibacterial ratio of the sample was calculated. Strains for the antibacterial test are *Staphylococcus aureus, Klebsiella pneumoniae* and *Escherichia coli*; culture conditions: 37° C.±2° C. and 90%+2%, incubation time: 18-24 hours.

The antibacterial ratio (antibacterial rate) shows that more than 95% has antibacterial property, and it has a better antibacterial property when greater than 98%.

Example 1

A method for manufacturing an easy-print packaging sheet, including the following technical steps:

(__) (I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

- a mass ratio of the carbon nanoflower to copper chloride was 1:0.5;
- a mass ratio of the carbon nanoflower to magnesium chloride was 1:2.5;
- a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and

- the mixture of the carbon nanoflower packaging material and polyethylene had a mass fraction of 10% in the spinning solution.

The carbon nanoflower packaging material had a mass fraction of 1% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 200° C. to obtain a flash-spinning fiber, and then lapped, hot pressed and lustered to obtain the packaging sheet, wherein the hot pressing temperature was 110° C., the lustring temperature was 120° C., and the lustring pressure was 40 Kg/cm.

Test data of the Example 1 is shown in Table 1.

Example 2

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.6;

a mass ratio of the carbon nanoflower to magnesium chloride was 1:2.6;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 10.5% in the spinning solution.

The carbon nanoflower packaging material had a mass fraction of 1.5% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 205° C. to obtain a flash-spinning fiber, and then lapped, hot pressed and lustered to obtain the packaging sheet, wherein the hot pressing temperature was 115° C., the lustring temperature was 121° C., and the lustring pressure was 42 Kg/cm.

Test data of the Example 2 is shown in Table 1.

Example 3

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.7;

a mass ratio of the carbon nanoflower to magnesium chloride was 1:2.7;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11% in the spinning solution.

The carbon nanoflower packaging material had a mass fraction of 2% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 44 Kg/cm.

Test data of the Example 3 is shown in Table 1.

Example 4

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.8;

a mass ratio of the carbon nanoflower to magnesium chloride was 1:2.8;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11.5% in the spinning solution.

The carbon nanoflower packaging material had a mass fraction of 2.5% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 215° C. to obtain a flash-spinning fiber, and then lapped, hot pressed and lustered to obtain the packaging sheet, wherein the hot pressing temperature was 125° C., the lustring temperature was 124° C., and the lustring pressure was 46 Kg/cm.

Test data of the Example 4 is shown in Table 1.

Example 5

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.9;

a mass ratio of the carbon nanoflower to magnesium chloride was 1:3;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 12% in the spinning solution.

The carbon nanoflower packaging material had a mass fraction of 3% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 220° C. to obtain a flash-spinning fiber, and then lapped, hot pressed and lustered to obtain the packaging sheet, wherein the hot pressing temperature was 130° C., the lustring temperature was 125° C., and the lustring pressure was 48 Kg/cm.

Test data of the Example 5 is shown in Table 1.

Example 6

A method for manufacturing an easy-print polypropylene packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.5;

a mass ratio of the carbon nanoflower to magnesium chloride was 1:2.5;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polypropylene were dissolved into a spinning solvent to obtain the spinning solution; and the mixture of the carbon nanoflower packaging material and polypropylene had a mass fraction of 10% in the spinning solution.

The carbon nanoflower packaging material had a mass fraction of 1% in the mixture of the carbon nanoflower packaging material and polypropylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Polypropylene Packaging Sheet:

The spinning solution prepared in step (II) was subjected to flash spinning at a spinning temperature of 200° C. to obtain a flash-spinning fiber, and then lapped, hot pressed and lustered to obtain the polypropylene packaging sheet, wherein the hot pressing temperature was 110° C., the lustring temperature was 120° C., and the lustring pressure was 40 Kg/cm.

Test data of the Example 6 is shown in Table 1.

Example 7

A method for manufacturing an easy-print polypropylene packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.7;

a mass ratio of the carbon nanoflower to magnesium chloride was 1:2.7;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polypropylene were dissolved into a spinning solvent to obtain the spinning solution; and the mixture of the carbon nanoflower packaging material and polypropylene had a mass fraction of 11% in the spinning solution.

The carbon nanoflower packaging material had a mass fraction of 2% in the mixture of the carbon nanoflower packaging material and polypropylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Polypropylene Packaging Sheet:

The spinning solution prepared in step (II) was subjected to flash spinning at a spinning temperature of 210° C. to obtain a flash-spinning fiber, and then lapped, hot pressed and lustered to obtain the polypropylene packaging sheet, wherein the hot pressing temperature was 120° C., the lustring temperature was 123° C., and the lustring pressure was 44 Kg/cm.

Test data of the Example 7 is shown in Table 1.

Example 8

A method for manufacturing an easy-print polypropylene packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

- a mass ratio of the carbon nanoflower to copper chloride was 1:0.9;
- a mass ratio of the carbon nanoflower to magnesium chloride was 1:3;
- a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polypropylene were dissolved into a spinning solvent to obtain the spinning solution; and

- the mixture of the carbon nanoflower packaging material and polypropylene had a mass fraction of 12% in the spinning solution.

The carbon nanoflower packaging material had a mass fraction of 3% in the mixture of the carbon nanoflower packaging material and polypropylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Polypropylene Packaging Sheet:

The spinning solution prepared in step (II) was subjected to flash spinning at a spinning temperature of 220° C. to obtain a flash-spinning fiber, and then lapped, hot pressed and lustered to obtain the polypropylene packaging sheet, wherein the hot pressing temperature was 130° C., the lustring temperature was 125° C., and the lustring pressure was 48 Kg/cm.

Test data of the Example 8 is shown in Table 1.

Comparative Example 1

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

- a mass ratio of the carbon nanoflower to copper chloride was 1:0.7;
- a mass ratio of the carbon nanoflower to magnesium chloride was 1:2.7;
- a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and

- the mixture of the carbon nanoflower packaging material and polyethylene had a mass fraction of 11% in the spinning solution.

The carbon nanoflower packaging material had a mass fraction of 3.5% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 44 Kg/cm.

Test data of the Comparative Example 1 is shown in Table 1.

Comparative Example 2

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

- a mass ratio of the carbon nanoflower to copper chloride was 1:0.7;
- a mass ratio of the carbon nanoflower to magnesium chloride was 1:2.7;
- a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and

- the mixture of the carbon nanoflower packaging material and polyethylene had a mass fraction of 11% in the spinning solution.

The carbon nanoflower packaging material had a mass fraction of 4% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 44 Kg/cm.

Test data of the Comparative Example 2 is shown in Table 1.

Comparative Example 3

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.7;

a mass ratio of the carbon nanoflower to magnesium chloride was 1:2.7;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11% in the spinning solution.

The carbon nanoflower packaging material had a mass fraction of 5% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 44 Kg/cm.

Test data of the Comparative Example 3 is shown in Table 1.

Comparative Example 4

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.7;

a mass ratio of the carbon nanoflower to magnesium chloride was 1:2.7;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11% in the spinning solution.

The carbon nanoflower packaging material had a mass fraction of 0.5% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 44 Kg/cm.

Test data of the Comparative Example 4 is shown in Table 1.

Comparative Example 5

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.7;

a mass ratio of the carbon nanoflower to magnesium chloride was 1:2.7;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11% in the spinning solution.

The carbon nanoflower packaging material had a mass fraction of 2% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 33 Kg/cm.

Test data of the Comparative Example 5 is shown in Table 1.

Comparative Example 6

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.7;

a mass ratio of the carbon nanoflower to magnesium chloride was 1:2.7;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11% in the spinning solution.

The carbon nanoflower packaging material had a mass fraction of 2% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 38 Kg/cm.

Test data of the Comparative Example 6 is shown in Table 1.

Comparative Example 7

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.7;

a mass ratio of the carbon nanoflower to magnesium chloride was 1:2.7;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11% in the spinning solution.

The carbon nanoflower packaging material had a mass fraction of 2% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 53 Kg/cm.

Test data of the Comparative Example 7 is shown in Table 1.

Comparative Example 8

A method for manufacturing an easy-print packaging sheet, including the following technical steps:

(I) Preparation of the Carbon Nanoflower Packaging Material:

The carbon nanoflower, copper chloride, and magnesium chloride were dissolved into a potassium hydroxide solution; ultrasonically stirred and mixed to generate a primary precipitate, the primary precipitate was heated and dried at a heating temperature of 180-190° C. for 1-2 hours to obtain an intermediate precipitate; the intermediate precipitate was calcinated at a calcination temperature of 320-360° C. for 2-3 hours to obtain the carbon nanoflower packaging material;

a mass ratio of the carbon nanoflower to copper chloride was 1:0.7;

a mass ratio of the carbon nanoflower to magnesium chloride was 1:2.7;

a mass ratio of the carbon nanoflower to potassium hydroxide was 1:18; and potassium hydroxide was kept excessive in the potassium hydroxide solution.

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11% in the spinning solution.

The carbon nanoflower packaging material had a mass fraction of 2% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 57 Kg/cm.

Test data of the Comparative Example 8 is shown in Table 1.

Comparative Example 9

A method for manufacturing an easy-print packaging sheet, including the following technical steps:

(I) Preparation of the Carbon Nanoflower Packaging Material: Carbon Nanoflower, Magnesium Oxide, and Copper Oxide were Mixed to Obtain the Carbon Nanoflower Packaging Material, where a Mass Ratio of the Carbon Nanoflower to Copper Oxide was 1:0.7, and a Mass Ratio of the Carbon Nanoflower to Magnesium Oxide was 1:2.7;

(II) Preparation of the Spinning Solution:

The carbon nanoflower packaging material prepared in step (I) and polyethylene were dissolved into a spinning solvent to obtain the spinning solution; and the mixture of the carbon nanoflower packaging material and polyethylene had a mass fraction of 11% in the spinning solution.

The carbon nanoflower packaging material had a mass fraction of 2% in the mixture of the carbon nanoflower packaging material and polyethylene.

The spinning solvent was a mixture of 1,2-dichloroethylene, trichlorofluoromethane, 2,3 dihydrodecafluoropentane, and 1,1,1,3,3-pentafluoropropane having a mass ratio of 3:5:1:1.

(III) Preparation of the Packaging Sheet:

The spinning solution prepared in step (II) was subjected to flash spinning at a spinning temperature of 210° C. to obtain a flash-spinning fiber, and then lapped, hot pressed and lustered to obtain the packaging sheet, wherein the hot pressing temperature was 120° C., the lustring temperature was 123° C., and the lustring pressure was 44 Kg/cm.

Test data of the Comparative Example 9 is shown in Table 1.

TABLE 1

Performance data table of the examples and comparative examples

| | Smoothness (seconds) | | Drape co- | Burst index | Light shielding | Anti-mould | Anti-bacterial |
|---|---|---|---|---|---|---|---|
| | Front | Back | efficient | kPa · $m^2$/g | rate | grade | ratio |
| Example 1 | 209 | 80 | 90.1% | 9.3 | 90.8% | 1 | 97.1% |
| Example 2 | 213 | 84 | 88.2% | 10.6 | 90.3% | 1 | 97.8% |
| Example 3 | 225 | 88 | 86.5% | 11.6 | 89.8% | 0 | 98.5% |
| Example 4 | 231 | 92 | 83.8% | 12.3 | 89.5% | 0 | 98.7% |
| Example 5 | 245 | 95 | 80.4% | 13.1 | 89.2% | 0 | 99.1% |
| Example 6 | 216 | 82 | 85.3% | 12.6 | 91.8% | 1 | 97.8% |

TABLE 1-continued

Performance data table of the examples and comparative examples

| | Smoothness (seconds) | | Drape co- | Burst index | Light shielding | Anti-mould | Anti-bacterial |
|---|---|---|---|---|---|---|---|
| | Front | Back | efficient | kPa · $m^2$/g | rate | grade | ratio |
| Example 7 | 237 | 90 | 81.2% | 15.9 | 88.8% | 0 | 98.8% |
| Example 8 | 256 | 98 | 75.8% | 17.2 | 86.2% | 0 | 99.4% |
| Comparative Example 1 | 257 | 106 | 78.7% | 13.0 | 88.6% | 0 | 99.2% |
| Comparative Example 2 | 263 | 119 | 77.1% | 12.7 | 86.9% | 0 | 99.3% |
| Comparative Example 3 | 286 | 142 | 74.5% | 12.4 | 83.2% | 0 | 99.4% |
| Comparative Example 4 | 189 | 77 | 91.6% | 7.6 | 91.2% | 3 | 91.6% |
| Comparative Example 5 | 182 | 55 | 89.4 | 8.8 | 95.6% | 2 | 96.8% |
| Comparative Example 6 | 202 | 69 | 87.9 | 9.7 | 92.7% | 2 | 97.6% |
| Comparative Example 7 | 253 | 101 | 84.2 | 12.8 | 85.3% | 0 | 98.9% |
| Comparative Example 8 | 277 | 132 | 81.8 | 13.5 | 81.4% | 0 | 99.0% |
| Comparative Example 9 | 205 | 72 | 84.3 | 6.6 | 86.7% | 3 | 80.5% |

Note:
the unit of smoothness is second, and the unit of burst index is kPa · $m^2$/g.

What is described are preferred embodiments of the present invention. It should be indicated that those skilled in the art could make several improvements and embellishments in the premise of not departing from the inventive concept. These improvements and embellishments should be regarded within the protection scope of the present invention.

The invention claimed is:

1. An easy-print packaging sheet, characterized by comprising polyethylene as a raw material;

a smoothness of the packaging sheet being 70-250 seconds, a drape coefficient of the packaging sheet being 78-92%, a burst index of the packaging sheet being 8-15 kPa·$m^2$/g, and a light shielding rate of the packaging sheet being 85-95%.

2. The easy-print packaging sheet of claim 1, characterized in that the smoothness of the packaging sheet is 200-250 seconds.

3. The easy-print packaging sheet of claim 1, characterized in that the smoothness of the packaging sheet is 70-100 seconds.

4. The easy-print packaging sheet of claim 1, characterized in that the drape coefficient of the packaging sheet is 80-85%.

5. The easy-print packaging sheet of claim 1, characterized in that the drape coefficient of the packaging sheet is 85-90%.

6. The easy-print packaging sheet of claim 1, characterized in that the burst index of the packaging sheet is 9-10 $kPa \cdot m^2/g$.

7. The easy-print packaging sheet of claim 1, characterized in that the burst index of the packaging sheet is 10-11 $kPa \cdot m^2/g$.

8. The easy-print packaging sheet of claim 1, characterized in that the burst index of the packaging sheet is 11-12 $kPa \cdot m^2/g$.

9. The easy-print packaging sheet of claim 1, characterized in that the light shielding rate of the packaging sheet is 89.5-90%.

10. The easy-print packaging sheet of claim 1, characterized in that the light shielding rate of the packaging sheet is 90-90.5%.

11. The easy-print packaging sheet of claim 1, characterized in that the raw material comprises polyethylene and a carbon nanoflower packaging material that is present in the packaging sheet in a mass fraction of 1-3%.

12. A method for manufacturing an easy-print packaging sheet, characterized by comprising the following technical steps: dissolving polyethylene and a carbon nanoflower packaging material into a spinning solvent to form a spinning solution, and performing flash spinning on the spinning solution at 160-240° C. to obtain a flash-spinning fiber, performing lapping, hot pressing and lustring on the flash-spinning fiber to obtain the packaging sheet, wherein a hot pressing temperature is 110-130° C., a lustring temperature is 120-125° C., and a lustring pressure is 40-48 Kg/cm.

* * * * *